US009580880B2

(12) United States Patent
Price

(10) Patent No.: US 9,580,880 B2
(45) Date of Patent: Feb. 28, 2017

(54) SHEETING PANELS FOR TRENCH-SHORING SYSTEMS

(71) Applicant: Ground Protection, LLC, Broomfield, CO (US)

(72) Inventor: Arthur L. Price, Charlotte, NC (US)

(73) Assignee: GROUND PROTECTION, LLC, Broomfield, CO (US)

( * ) Notice: Subject to any disclaimer, the term of this patent is extended or adjusted under 35 U.S.C. 154(b) by 0 days.

(21) Appl. No.: 14/477,412

(22) Filed: Sep. 4, 2014

(65) Prior Publication Data

US 2014/0377015 A1 Dec. 25, 2014

Related U.S. Application Data

(63) Continuation of application No. 13/548,729, filed on Jul. 13, 2012, now abandoned.

(60) Provisional application No. 61/508,154, filed on Jul. 15, 2011.

(51) Int. Cl.

| | |
|---|---|
| ***E02D 17/08*** | (2006.01) |
| ***E02D 29/045*** | (2006.01) |
| ***E02D 17/00*** | (2006.01) |

(52) U.S. Cl.

CPC ..... *E02D 17/08* (2013.01); *E02D 17/00* (2013.01)

(58) Field of Classification Search

CPC ..... E02D 17/00; E02D 17/02; E02D 17/04; E02D 17/06; E02D 17/08; E02D 17/083; E02D 17/086; E04B 2002/0258

USPC ..... 405/282, 283, 272; 52/125.2, 125.3

See application file for complete search history.

(56) References Cited

U.S. PATENT DOCUMENTS

| | | | | |
|---|---|---|---|---|
| 3,230,720 | A * | 1/1966 | Bennett | 405/282 |
| 3,335,573 | A * | 8/1967 | Ward | 405/282 |
| 3,362,168 | A * | 1/1968 | Dotlich | 405/283 |
| 3,766,740 | A * | 10/1973 | Teegen | 405/282 |
| 5,096,334 | A * | 3/1992 | Plank | 405/283 |
| 6,315,495 | B1 * | 11/2001 | Starheim | E02D 31/002 220/4.33 |
| 6,371,119 | B1 * | 4/2002 | Zadini | A61H 31/008 128/845 |
| 2005/0074300 | A1 * | 4/2005 | Kadiu | E02D 17/083 405/272 |
| 2008/0010936 | A1 * | 1/2008 | Vaughan | E01C 5/16 52/588.1 |

FOREIGN PATENT DOCUMENTS

| | | | | |
|---|---|---|---|---|
| GB | 191316024 A * | 0/1914 | | E02D 5/04 |
| GB | 2094373 A * | 9/1982 | | E02D 17/08 |
| WO | WO 0127395 A1 * | 4/2001 | | |

* cited by examiner

*Primary Examiner* — John Kreck
*Assistant Examiner* — Stacy Warren
(74) *Attorney, Agent, or Firm* — Holland & Hart

(57) ABSTRACT

A substantially rectangular trench shoring sheeting panel made primarily of polyethylene includes at least one pair of hand holes. In some embodiments, the sheeting panel includes a plurality of buttons protruding outwardly from one of the sheeting panel's surfaces. As compared to three-quarter inch FinnForm, the polyethylene sheeting panel typically has (i) equivalent or superior structural properties and (ii) a significantly lower useful-life cost.

19 Claims, 1 Drawing Sheet

SHEETING PANELS FOR TRENCH-SHORING SYSTEMS

CROSS-REFERENCE TO PRIORITY APPLICATIONS

This application is a continuation of U.S. patent application Ser. No. 13/548,729, for Sheeting Panels for Trench Shoring (filed Jul. 13, 2012, and published Jan. 17, 2013, as Publication No. 2013/0017021 A1), which claims the benefit of and priority to U.S. Provisional Patent Application Ser. No. 61/508,154 (filed Jul. 15, 2011). This application incorporates each of U.S. patent application Ser. No. 13/548,729, U.S. Patent Application Publication No. 2013/0017021 A1, and U.S. Provisional Patent Application Ser. No. 61/508,154 by reference in its entirety.

BACKGROUND

The present invention relates to the field of shoring systems for supporting the sides of a trench or hole in the ground and, in particular, sheeting panels for hydraulic shoring techniques.

Various shoring techniques have been employed for supporting the sides of a trench or hole in the ground during excavation. One shoring technique, called "aluminum hydraulic shoring," employs hydraulic jacks, aluminum shoring rails, and shoring sheeting panels to support the sides of the trench. After a portion of the trench is excavated, two sheeting panels may be placed substantially parallel to one another on opposite sides of the trench. The shoring rails, typically already connected by the hydraulic jacks, are then placed on the faces of the two sheeting panels. The hydraulic jacks extend perpendicularly from the face of one sheeting panel to the face of the second sheeting panel. After proper placement of the shoring rails and hydraulic jacks, the hydraulic cylinders within the jacks are pressurized. Alternatively, the hydraulic shoring rails may be fastened to the sheeting panels, and then the assembly of rails and panels may be placed in the trench.

In 1989, the Occupational Safety and Health Administration (OSHA) adopted Federal Standard 29 CFR 1926, Subpart-P establishing safety requirements for excavation worksites. In particular, Regulation 1926, Subpart-P, Appendix D includes item (g)(7) identifying the types of shore sheeting that may be used for aluminum hydraulic shoring for trenches. Item (g)(7) states: "Plywood shall be 1.125 inch thick softwood or 0.75 inch thick, 14 ply, arctic white birch (Finland form). Please note that plywood is not intended as a structural member, but only for prevention of local raveling (sloughing of the trench face) between shores."

The OSHA Subpart P Standard also requires (i) manufacturers of shoring equipment to develop their own tabulated data for the aluminum hydraulic shoring equipment they develop, and (ii) users of the equipment to adhere to the data developed for the shoring rails and sheeting panels they are using. To afford themselves broader liability protection, most manufacturers of hydraulic shoring have tried to stay as close as possible to the data developed by OSHA. Other types of sheeting such as steel plate and plywood with performance equivalent to and even less than three-quarter-inch, 14 ply, Artic White Birch (Finland form or "Finnform") have been allowed. Finnform plywood is a relatively difficult standard to meet or exceed so it is used as the calibration standard within the industry.

To date, plywood has primarily been used for shoring sheeting panels. Although plywood performs well as a shoring panel, the material also has a number of drawbacks. In particular, water, mud, and drying cause the plywood panels to gray and eventually delaminate. The handling and installation of plywood panels also breaks the corners of the plywood panels. Thus, the useful life of plywood sheeting panels is approximately one to two years.

Additionally, plywood breaks and punctures relatively easily. If a plywood sheeting panel is punctured or an edge of the panel is broken, the overall area of restraint provided by the panel is reduced. Unrestrained areas of soil and rock may shift and move, creating potential safety hazards.

As noted, plywood sheeting panels can be damaged during handling, which may include dragging the panel. Over time, the panel becomes bent in the face plane, and breaking and splintering occurs on the face of the panel. As the deterioration progresses, the coverage and effectiveness of the sheeting becomes less than intended. Furthermore, splintering on the edges and face of the plywood present a safety hazard to workers handling the shores (e.g., the assembly of shore rails and sheeting panels). Even with gloves on, large plywood splinters can penetrate the hands and other parts of the body. Workers inside the trench that are not handling the shores can still brush up against the shore, receiving puncture wounds. Working at the trench level exposes the upper body and head to the surrounding shoring sheeting.

To combat these issues, metal edge protectors may be installed on plywood sheeting panels, and the shores may be cleaned and refurbished after each use. The cost and time associated with replacing the plywood panels, installing metal edge protectors, and cleaning the shores can be excessive.

Therefore, a need exists for an improved sheeting panel that meets or exceeds the OSHA regulations for aluminum hydraulic shoring for trenches. More particularly, there exists a need for a sheeting panel that reduces the long-term cost of maintaining and installing shoring systems and is durable, easy to handle and maintain, and safe for both shore installers and workers inside the trench.

SUMMARY

In one aspect, the present invention embraces a substantially rectangular trench shoring sheeting panel made primarily of polyethylene. The sheeting panel includes a front surface, a rear surface, and four edges.

In an exemplary embodiment, the sheeting panel includes at least one pair of hand holes extending through the front surface and the rear surface. Each of the hand holes is separated a lateral distance from the other along one of the sheeting panel's four edges.

In another exemplary embodiment, the sheeting panel includes four pairs of hand holes extending through its front surface and rear surface. Each pair of hand holes is typically located along a different edge of the sheeting panel. Within each pair of hand holes, each hand hole is separated a lateral distance from the other along one of the sheeting panel's four edges.

In yet another exemplary embodiment, at least one side of the sheeting panel includes buttons protruding outward from a majority of the sheeting panel's surface.

In yet another exemplary embodiment, a strip of area extending centrally across the length of the sheeting panel's surface is free of buttons.

In yet another exemplary embodiment, the sheeting panel includes four corner holes located in each of the shoring panel's corners.

BRIEF DESCRIPTION OF THE DRAWINGS

The foregoing and other objects and advantages of the invention and the manner in which the same are accomplished will become clearer based on the following detailed description taken in conjunction with the accompanying drawings in which.

DETAILED DESCRIPTION

The invention will now be described more fully hereinafter with reference to the accompanying drawings, in which multiple embodiments of the invention are shown. This invention may, however, be embodied in different forms and should not be construed as limited to the embodiments set forth herein. Rather, these embodiments are provided so that this disclosure will be thorough and complete and will fully convey the scope of the invention to those skilled in the art. Like numbers refer to like elements throughout.

Figure 1:
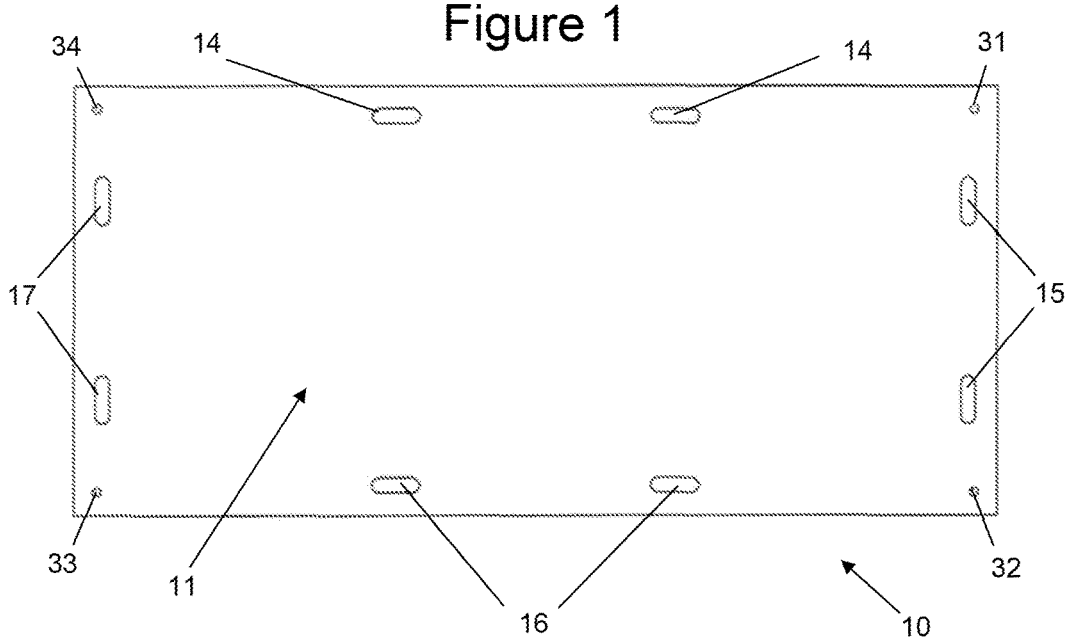
FIG. 1 is an anterior plan view of a sheeting panel in accordance with one embodiment of the invention.
Figure 2:
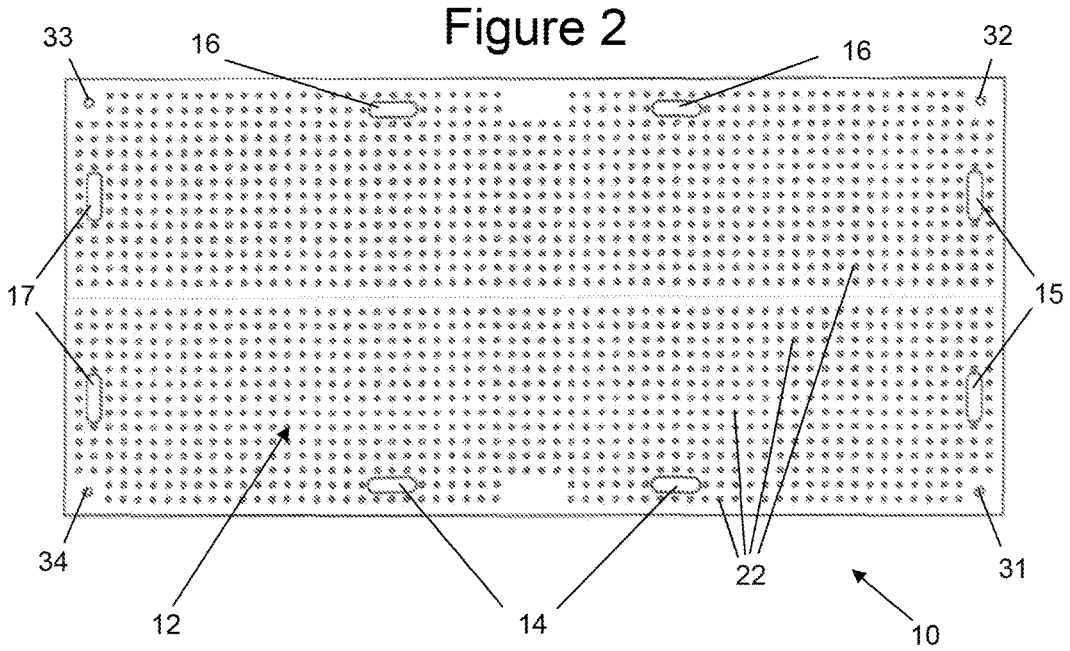
FIG. 2 is a posterior plan view of a sheeting panel in accordance with one embodiment of the invention.

The present invention embraces a sheeting panel made primarily of polyethylene. As depicted in FIGS. 1 and 2, the sheeting panel 10 has a substantially rectangular shape. The term "substantially rectangular" is meant to succinctly describe a simple geometric shape approximating a rectangle. In this regard, the sheeting panel 10 includes a front surface 11 (FIG. 1) and a rear surface 12 (FIG. 2). The terms "front" and "rear" are simply meant to distinguish the two sides of the sheeting panel 10. In exemplary embodiments, the sheeting panel 10 is approximately 44.5 inches wide, 96 inches long, and has a thickness of approximately half an inch.

The sheeting panel 10 typically includes four pairs of hand holes 14, 15, 16, and 17 to facilitate safe handling. The hand holes 14, 15, 16, and 17 may be molded into the polyethylene sheeting panel 10 during manufacturing. Alternatively, the hand holes 14, 15, 16, and 17 may be cut out of the sheeting panel 10. For a given pair of hand holes 14, 15, 16, or 17, the hand holes are typically separated a lateral distance from each other (i.e., spaced apart) along one of the four edges of the sheeting panel.

As depicted in FIG. 1, a pair of hand holes 15 is located at the right end of the sheeting panel 10. The left end of the sheeting panel 10 includes a pair of hand holes 17. The top edge of the sheeting panel 10 includes a pair of hand holes 14. Finally, a pair of hand holes 16 is located at the bottom edge of the sheeting panel 10. The terms "right" and "left" are used simply to distinguish the two ends of the sheeting panel. Similarly, the terms "top" and "bottom" are used to distinguish the two lengthwise edges of the sheeting panel. As clearly shown in FIG. 1, the pairs of hand holes 14, 15, 16, 17 each are elongated in a direction that extends parallel to their nearest respective side or end edges.

As noted, the sheeting panel typically includes pairs of hand holes. That said, the sheeting panel 10 may include individual hand holes. For example, if the width of the sheeting panel is relatively small, a single hand hole may be sufficient to facilitate safe handling.

The sheeting panel 10 may also include four corner holes 31, 32, 33, and 34. As depicted in FIG. 1, corner hole 31 is offset from the top edge and right end of the sheeting panel 10. Corner holes 32, 33, and 34 are similarly offset from their respective edges and ends. Ropes or cables may be passed through the corner holes 31, 32, 33, and 34 to facilitate installation or removal of the sheeting panel 10. The corner holes 31, 32, 33, and 34 may be molded into the polyethylene sheeting panel 10 during manufacturing. Alternatively, the corner holes 31, 32, 33, and 34 may be drilled or cut out of the sheeting panel 10.

As depicted in FIG. 2, at least one side of the sheeting panel 10 typically includes a plurality of buttons 22 (e.g., dimples). The buttons 22 protrude outward from the rear surface 12 of the sheeting panel 10 to increase the frictional force (i.e., provide extra traction) between the shore rails and the sheeting panel 10, thereby reducing the risk of sliding or slipping. Typically, the plurality of buttons 22 is located on a majority of the sheeting panel's surface (e.g., between about 60 and 90 percent of the sheeting panel's surface). As clearly shown in FIG. 2, the plurality of buttons 22 may be arranged in an orthogonal grid pattern. In some embodiments, a strip of area extending centrally across the length of the sheeting panel's surface is free of buttons (i.e., no buttons protrude from the panel's surface in this area). In some arrangements, the strip of area may space apart at least two portions of the orthogonal grid pattern of the plurality of buttons 22 from each other.

Alternatively, the side of the sheeting panel 10 facing the trench wall may include buttons 22. In such an arrangement, the buttons 22 increase the frictional force (i.e., provide extra traction) between the vertical face of the trench, thereby reducing the risk of sliding or slipping.

As previously noted, the sheeting panel is made primarily of polyethylene, which provides significant advantages in terms of both convenience and structural performance as compared to typical FinnForm plywood sheeting panels. The polyethylene sheeting panel may be manufactured in a variety of colors (e.g., black or white), and is easily cleaned by spray washing. Furthermore, the polyethylene sheeting panels can be cut and drilled with the same tools that are used for plywood sheeting panels.

From a structural standpoint, the polyethylene sheeting panels provide additional benefits. For example, the polyethylene sheeting panels do not splinter or delaminate on the panel-face or edges. Furthermore, the polyethylene sheeting panels deflect rather than breaking when loaded excessively. A 44.5-inch-wide, 96-inch-long, and half-inch-thick polyethylene sheeting panel weighs approximately seventy-eight pounds. The polyethylene sheeting panels also meet or exceed the structural properties of three-quarter inch FinnForm.

Table 1 (below) is a comparison of physical and structural properties of polyethylene sheeting panels to the plywood panels allowed in OSHA Regulation 1926, Subpart-P, Appendix D, item (g)(7).

TABLE 1

| Panel | Thickness (inch) | Ultimate Bending Strength (psi) | Unit Weight per (psf) | Maximum Bending Moment (in-lb) | Modulus of Elasticity (ksi) | Moment of Inertia ($in^4$) | Section Modulus ks ($in^4$) |
|---|---|---|---|---|---|---|---|
| Polyethylene | 0.5 | 6700 | 2.63 | 3350 | 304 | 0.125 | 0.500 |
| FinnForm | 0.75 | 6244 | 2.71 | 3465 | 1830 | 0.183 | 0.555 |
| Softwood | 1.125 | 3300 | 3.30 | 2455 | 1800 | 0.27 | 0.744 |

Despite the fact that OSHA Regulation 1926 does not consider sheeting to be a structural member, from an engineering standpoint, a structural comparison is an appropriate way to compare the panels. In a structural sense, 1.125-inch-thick softwood is inferior to both polyethylene sheeting panels and FinnForm. Maximum bending moment is a particularly notable value in Table 1 because, if a panel were to fail by trench wall collapse, bending would be the failure mode of the sheeting. Although the FinnForm panel has a higher maximum bending moment than the polyethylene sheeting panel, the overall analysis indicates that the polyethylene sheeting panel is technically equivalent to the FinnForm panel.

The modulus of elasticity is much lower for polyethylene sheeting panels. Although this indicates that the panel will deflect more when loaded, for the purpose of preventing local raveling, it is considered an advantage because it allows the shore and sheeting to conform to the trench wall without breaking the sheeting. The higher modulus of elasticity associated with plywood and FinnForm is an indication that it is more brittle and will break, delaminate, or puncture more easily. A complete structural analysis of the sheeting panels of Table 1 can be found in Appendix 1 of priority U.S. Provisional Patent Application Ser. No. 61/508,154, wherein the polyethylene sheeting panel is referred to as the "SHOR-MAT Panel."

Additional mechanical tests were performed on polyethylene sheeting panels in accordance with some embodiments of the present invention. The results of those tests can be found in Appendix 2 of priority U.S. Provisional Patent Application Ser. No. 61/508,154.

The polyethylene sheeting panel of the present invention also facilitates a reduction in the cost associated with maintaining and installing shoring equipment. In this regard, the following exemplary cost comparison between polyethylene sheeting panels and FinnForm sheeting panels demonstrates that the inventive sheeting panels can facilitate a substantial cost savings.

EXAMPLE

The use of sheeting with hydraulic shoring applications is dependent on depth of excavation and soil type. In general, sheeting is required in excavations over 10 feet deep in OSHA type B and C soils. The sheeting may be attached to the shoring or set inside the excavation before the shore (i.e., the shore rails and hydraulic jack) is set and pressurized. Generally, on the West Coast and South Coast, sheeting is attached to the shore, and, on the East Coast, it is set independently from the shore.

Shoring panels become damaged on the corners by rigging, dragging on the surface during installation, and removal. Plywood also becomes bent and broken due to raveled and uneven trench walls. Plywood is often cut to fit around pipes and other obstructions. Weather and ground water table conditions also have an effect on the quantity of plywood used and the life expectancy of the sheeting panels. Wet weather and coastal regions will utilize more shoring sheeting than arid and central states. The purchase and installation of shoring sheeting panels is done at the local supplier level rather than at the manufacturer's level.

Table 2 (below) presents the summarized results of a cost estimate of a useful life cost comparison between polyethylene sheeting panels and FinnForm sheeting panels.

TABLE 2

| Panel | Material Cost (per sheet) | Unit Cost (per year) | Total Cost per 100 sheets (over 10 years) |
|---|---|---|---|
| FinnForm | $90.00 | $72.33 | $72,327 |
| Polyethylene | $180.00 | $21.57 | $21,572 |

In a major municipality on the West Coast a shoring supplier installs 300 sheets of 4-foot×8-foot FinnForm on 150 hydraulic shores every two years. The useful life of the FinnForm sheeting is two years. The typical soils that the sheeting is used in are either coarse sands and gravels or medium stiff sandy clays. Rainfall is heavy in the winter and water tables are high, within 8 feet of the surface.

The useful life of polyethylene sheeting panels is assumed to be over 10 years. This useful life assumption is supported by experience using polyethylene materials in other harsher construction applications. The cost of polyethylene sheeting panels is double (i.e., 2×) the cost of FinnForm. The analysis includes the cost of purchasing the panels, installing them on the shores, removing the panels from the shores and disposing of the dilapidated sheeting, and maintaining the shores after each use. Labor cost is assumed to be from the shoring supplier's general warehouse and yard maintenance workforce.

As shown in Table 2, the cost of operating and maintaining a trench shoring operation can be significantly reduced by using the polyethylene sheeting panels of the present invention. The complete cost analysis used to generate Table 2 can be found in Appendix 3 of priority U.S. Provisional Patent Application Ser. No. 61/508,154, wherein the polyethylene sheeting panel is referred to as the "SHOR-MAT Panel."

In the drawings and specification, there have been disclosed typical embodiments on the invention and, although specific terms have been employed, they have been used in a generic and descriptive sense only and not for purposes of limitation, the scope of the invention being set forth in the following claims.

The invention claimed is:

1. A trench-shoring system for supporting opposite sides of a trench during ground excavation, comprising:

a first trench-shoring sheeting panel; and a second trench-shoring sheeting panel;

wherein each of the first and second trench-shoring sheeting panels comprises:

polyethylene;

a rectangular-shaped perimeter having first and second side edges, first and second end edges, and four corners;

front and rear surfaces;

a plurality of protrusions positioned on at least one of the front and rear surfaces, the plurality of protrusions being arranged in a first orthogonal grid pattern and a second orthogonal grid pattern, wherein a strip of area extends centrally across the at least one of the front and rear surfaces between the first and second orthogonal grid patterns, the strip of area being free of the plurality of protrusions, the strip of area having a width greater than a distance between immediately adjacent protrusions of the plurality of protrusions in the first orthogonal grid pattern;

a plurality of elongated hand holes, a first pair of the plurality of elongated hand holes being elongated along a direction parallel to the first side edge and being positioned adjacent to the first side edge, a second pair of the plurality of elongated hand holes being elongated along a direction parallel to the second side edge and being positioned adjacent to the second side edge, a third pair of the plurality of elongated hand holes being elongated along a direction parallel to the first end edge and being positioned adjacent to the first end edge, and a fourth pair of the plurality of elongated hand holes being elongated along a direction parallel to the second end edge and being positioned adjacent to the second end edge; and wherein the trench-shoring sheeting panels are configured to support the sides of a trench during ground excavation by (i) positioning the respective first and second trench-shoring sheeting panels against opposite sides of the trench and (ii) using a jack to exert forces against the respective first and second trench-shoring sheeting panels in order to support the sides of the trench.

2. A trench-shoring system according to claim 1, wherein the trench-shoring sheeting panels are configured to be held spaced apart from each other with a plurality of shoring rails that are positioned between the jack and the trench-shoring sheeting panels.

3. A trench-shoring system according to claim 1, wherein the trench-shoring sheeting panels consist essentially of polyethylene.

4. A trench-shoring system according to claim 1, wherein the trench-shoring sheeting panels consist essentially of polyethylene having a modulus of elasticity of less than 1000 ksi.

5. A trench-shoring system according to claim 1, wherein the jack is a hydraulic jack.

6. A trench-shoring system according to claim 1, wherein the first and second trench-shoring sheeting panels are configured to be positioned substantially parallel to one another.

7. A trench-shoring system according to claim 1, wherein each of the trench-shoring sheeting panels further comprises a corner hole positioned at each of the four corners.

8. A trench-shoring system according to claim 1, wherein the plurality of protrusions are arranged in a plurality of rows and columns and located on between about 60% and 90% of the at least one of the front and rear surfaces.

9. An excavated trench having supported sides, comprising:

a first, substantially rectangular trench-shoring sheeting panel positioned against a first side of the trench;

a second, substantially rectangular trench-shoring sheeting panel positioned against a second side of the trench; and wherein each of the first and second trench-shoring sheeting panels comprises:

polyethylene;

first and second side edges;

first and second end edges;

four corners;

front and rear surfaces;

a plurality of protrusions positioned on at least one of the front and rear surfaces, the plurality of protrusions being arranged in a first orthogonal grid and a second orthogonal grid, the first and second orthogonal grids each having a plurality of rows and columns and located on between about 60% and 90% of the at least one of the front and rear surfaces, wherein a strip of area extends centrally across the at least one of the front and rear surfaces between the first and second orthogonal grids, the strip of area being free of the plurality of protrusions and having a width greater than a distance between immediately adjacent protrusions of the plurality of protrusions in the first orthogonal grid pattern;

a plurality of pairs of elongate-shaped hand holes, each pair of the plurality of pairs of elongate-shaped hand holes being elongated in directions parallel to one of the first and second side edges or the first and second end edges, each pair of the plurality of pairs of elongate-shaped hand holes being positioned adjacent to one of the first and second side edges or the first and second end edges;

a circular corner hole positioned adjacent to each of the four corners and dimensioned for a rope or shoring cable to pass therethrough; and wherein the first and second trench-shoring sheeting panels are configured to be pressed against the first and second sides of the trench, respectively, by a jack to prevent sloughing of the trench.

10. An excavated trench having supported sides according to claim 9, wherein the trench-shoring sheeting panels are configured to be held spaced apart from each other with a plurality of shoring rails that are positioned between the jack and the trench-shoring sheeting panels.

11. An excavated trench having supported sides according to claim 9, wherein the trench-shoring sheeting panels consist essentially of polyethylene.

12. An excavated trench having supported sides according to claim 9, wherein the trench-shoring sheeting panels consist essentially of polyethylene having a modulus of elasticity of less than 1000 ksi.

13. An excavated trench having supported sides according to claim 9, wherein the jack is a hydraulic jack.

14. An excavated trench having supported sides according to claim 9, wherein the first and second trench-shoring sheeting panels are configured to be positioned substantially parallel to one another.

15. An excavated trench having supported sides according to claim 9, wherein the first side edge comprises a first length having a first midpoint, the second side edge comprises a second length having a second midpoint, wherein at least a first pair of hand holes of the plurality of pairs of hand holes are evenly spaced from the first midpoint along the first length and at least a second pair of hand holes of the plurality of pairs of hand holes are evenly spaced from the second midpoint along the second length.

16. A method for supporting opposite sides of an excavated trench, comprising:

providing first and second substantially rectangular trench-shoring sheeting panels, each comprising:

polyethylene, a rectangular-shaped perimeter, the rectangular-shaped perimeter having first and second side edges, first and second end edges, and four corners, front and rear surfaces, a plurality of protrusions positioned on at least one of the front and rear surfaces, the plurality of protrusions being arranged in at least two orthogonal grid areas spaced apart from each other by a strip of area extending centrally across the length of the at least one of the front and rear surfaces, the strip of area being free of the plurality of protrusions, the strip of area having a width greater than a distance between immediately adjacent protrusions of the plurality of protrusions in at least one of the at least two orthogonal grid areas, a plurality of pairs of elongated hand holes, each of the plurality of pairs of elongated hand holes being positioned adjacent to one of the first and second side edges and first and second end edges, each of the elongated hand holes being elongated in a direction parallel to their respective adjacent one of the first and second side edges or first and second end edges, each of the plurality of pairs of elongated hand holes being spaced apart from each other, and a corner hole positioned adjacent to each of the four corners;

positioning the first trench-shoring sheeting panel against a first side of the trench;

positioning the second trench-shoring sheeting panel against a second side of the trench, the second side being opposite the first side of the trench; and exerting force against the respective first and second trench-shoring sheeting panels in order to apply sufficient pressure against the first and second sides of the trench to prevent sloughing of a face of the trench.

17. The method according to claim 16, wherein the first and second trench-shoring sheeting panels are configured to receive at least one of a jack and shoring rails between the trench-shoring sheeting panels which operate to exert the force.

18. The method according to claim 16, wherein the trench-shoring sheeting panels consist essentially of polyethylene.

19. The method according to claim 16, wherein the trench-shoring sheeting panels consist essentially of polyethylene having a modulus of elasticity of less than 1000 ksi.

* * * * *